United States Patent [19]

Hill et al.

[11] Patent Number: 4,516,448

[45] Date of Patent: May 14, 1985

[54] PUNCH AND RAM ASSEMBLY FOR PUNCH PRESS

[75] Inventors: Ronald C. Hill, Corfu; Richard M. Stein, Lancaster; Raymond J. Bzibziak, Akron; Robert Goodwill, North Tonawanda, all of N.Y.

[73] Assignee: Houdaille Industries, Inc., Ft. Lauderdale, Fla.

[21] Appl. No.: 415,600

[22] Filed: Sep. 7, 1982

[51] Int. Cl.[3] ..... B26D 7/04

[52] U.S. Cl. ..... 83/137; 83/143; 83/461

[58] Field of Search ..... 83/137, 461, 390, 460, 83/138, 139, 142

[56] References Cited

U.S. PATENT DOCUMENTS

| | | | |
|---|---|---|---|
| 3,529,502 | 10/1970 | Hoffmann et al. | 83/137 |
| 4,030,391 | 6/1977 | Swanson et al. | 83/137 |
| 4,096,727 | 6/1978 | Gargaillo | 83/390 |
| 4,096,774 | 6/1978 | Kaufmann | 83/691 |
| 4,261,237 | 4/1981 | DiDonato, Jr. et al. | 83/139 |

*Primary Examiner*—Donald R. Schran
*Assistant Examiner*—James Wolfe
*Attorney, Agent, or Firm*—Hill, Van Santen, Steadman & Simpson

[57] ABSTRACT

A punch and ram assembly for a punch press which clamps a workpiece prior to punching with the same mechanism used to strip the workpiece from the punch as the punch is retracted. The elements of the clamping and stripping mechanism are carried and actuated by the ram and its motion. The invention allows for adjusting the clamping and stripping force.

7 Claims, 4 Drawing Figures

10
11
14
16
17
13
32
41
36
38
29
15
21
20
40
37
45
IV
IV
49
43
P
51
48
52

10
11
14
16
13
32
40
36
29
15
21
20
40
41
27
37
38
45

14
40
13

14
11
13
32
40
27
38
29
15
21
20
40
41
37
36
45

PUNCH AND RAM ASSEMBLY FOR PUNCH PRESS

BACKGROUND OF THE INVENTION

1. Field of the Invention

This invention relates to a punch and ram assembly for punching workpieces and more specifically with guiding the punch and holding down the workpiece during the punching operation and also with stripping the punch from the workpiece after punching is completed.

2. Prior Art

Various types of punch press machines have in the past been provided with effective punch guiding and stripper arrangements to prevent damage or distortion to the workpieces. These devices have performed well when punching thin and moderate thicknesses of sheet metal. However, with the large presses capable of perforating heavy metal such as plate steel or the like, the stripping devices previously utilized are generally undesirable. With punching thicker metal plates the forces to withdraw the punches from the metal are large and in some instances may approach the downward punching forces. If sufficiently heavy stripper springs would be employed for use with plate stamping it would require excess space and also necessitate high forces to compress these heavy springs thereby adding greatly to the forces required in the punching operation. Further, when sheet metal is also to be worked on the same high compressive forces are required to compress these heavy stripper springs when only limited stripping forces are necessary.

SUMMARY OF THE INVENTION

According to the present invention a punch guide and stripper arrangement is provided for use on presses which can accommodate a relatively thick metal plate having a hydraulic actuated ram. The ram carries a plurality of stripper pistons in suitable piston chambers being limitly movable independent of the ram for abutting a punch guiding stripper sleeve to urge it into clamping engagement with the workpieces. Pressurized hydraulic fluid acting against the stripper pistons are arranged to maintain a high clamping force during the punching operation and retain this desirable clamping (and hold-down) function during the ram's retraction travel. To maintain this holding force while the ram is retracting, the stripper pistons extend from their ram chambers at a rate equal to the upward travel of the ram.

The ram forces the clamping pistons upward to backflush hydraulic fluid from the piston chambers on the ram's down stroke and the hydraulic fluid is then restored to the piston chambers on the ram's retraction stroke. The stripping and clamping force is easily adjustable for different plate thicknesses by varying the hydraulic pressure in the stripper system thereby conserving energy by establishing only the force required to do the job. Accordingly, it is an object of the present invention to provide a punch guide and stripper arrangement which can generate the necessary clamping force and stripping action to accommodate various thicknesses of sheet and plate materials.

Another object of the present invention is to provide a punch guide and stripper arrangement in which the clamping forces are made adjustable to accommodate a wide range of sheet and plate thicknesses.

Yet another object of the present invention is to provide hydraulic operated stripper pistons carried by a punch press ram and capable of limited independent movement of the ram during certain portions of the ram's reciprocable movement.

Still another object of the present invention is to provide a mechanism for clamping a workpiece prior to punching and to use the same mechanism for stripping the workpiece off the punch as it is being retracted. All elements of the mechanism are carried on the ram and are actuated by its motion.

Many other advantages, features and additional objects of the present invention will become apparent to those skilled in the art upon referring to the detailed description and the accompanying sheet of drawings in which a preferred structural embodiment incorporating the principles of the present invention is shown by way of illustrative example.

ON THE DRAWINGS

DESCRIPTION OF THE PREFERRED EMBODIMENT

Figure 1:
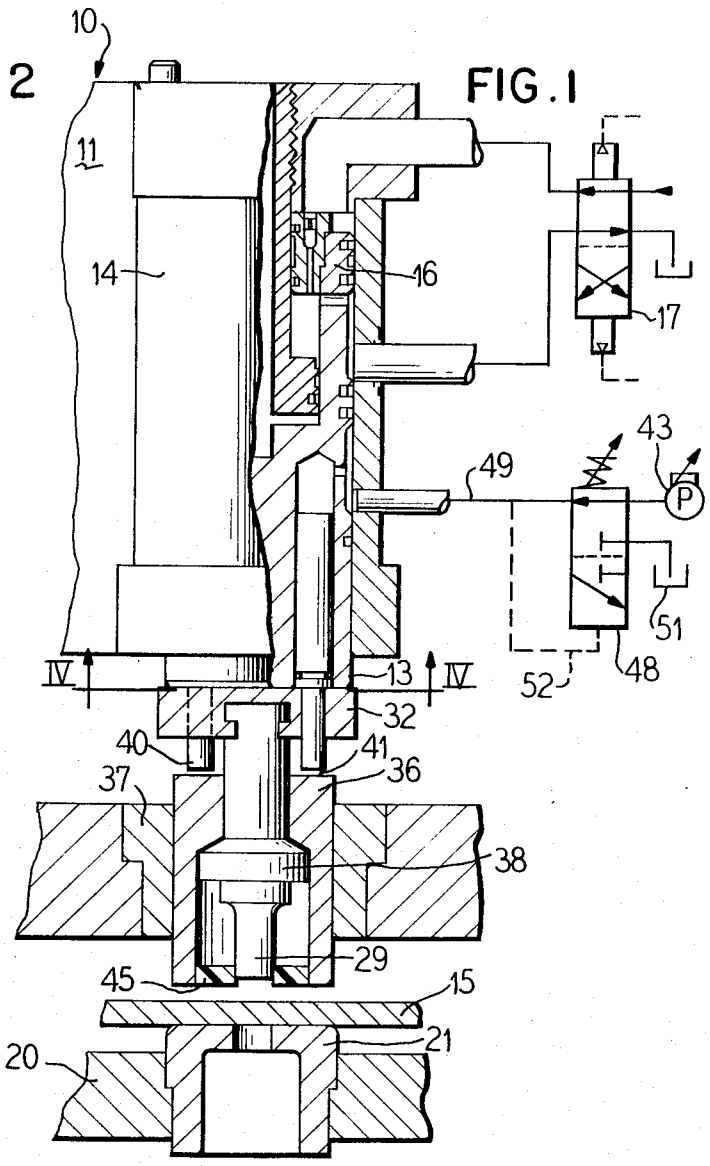
FIG. 1 is a fragmentary partial sectional view of a punching device in accordance with the present invention.
Figure 2:
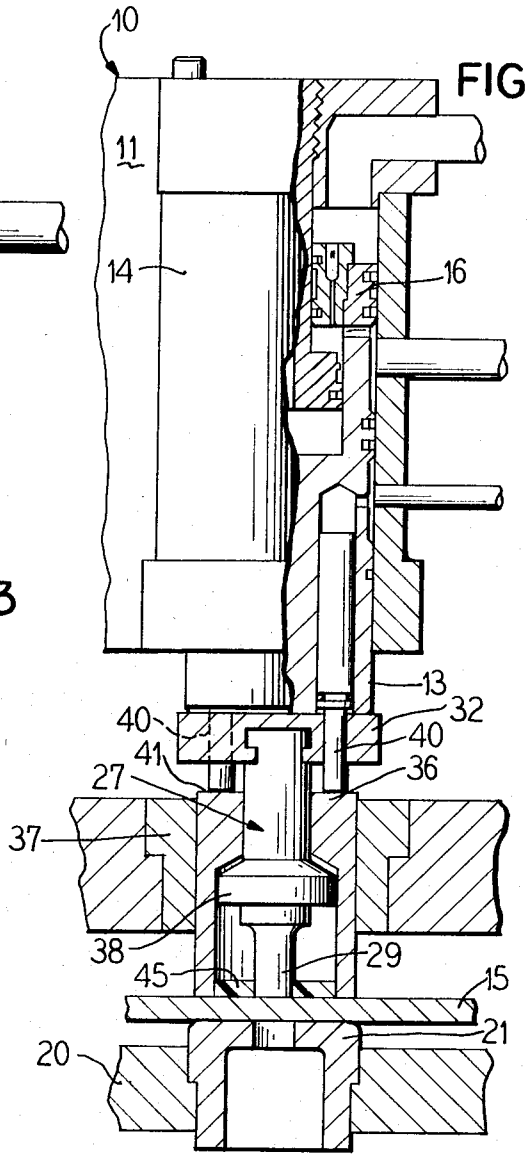
FIG. 2 is a view similar to FIG. 1 but showing the ram and punch in a descending position with the punch guide and stripper sleeve in a workpiece clamping position.

FIG. 1 illustrates a punching device 10 shown fragmentarily and which may be of a design to accommodate punching a wide range of plate and sheet metal thicknesses. The device 10, such as a turret punch of the type generally shown in U.S. Pat. No. 4,096,774 issued to Kaufmann, includes a frame 11 carrying a turret 12 which is positionable below and in axial alignment with a ram 13. The ram 13 is supported on the frame by means of a hydraulic cylinder body 14 and is arranged to reciprocably move toward and away from a workpiece 15. The ram includes a piston head 16 being movable within the cylinder body 14 by the operation of a solenoid controlled four-way valve 17 to pressurize a desired end of the piston head 16.

The frame further includes a lower member 20 supporting a die 21 upon which the workpiece 15 is positioned for punching. A punch 27 includes a driver portion or body 28 and a tip 29 which is complementary to the die 21. Any suitable tooling may be utilized such as round or shaped configurations selected in accordance with a given punching operation. The body 28 of the punch includes a Tee head 31 which is supported in a Tee slot formed in a striker plate 32. The striker plate in turn is mounted to the ram 13 for reciprocating movement therewith toward and away from said workpiece 15.

Figure 4:
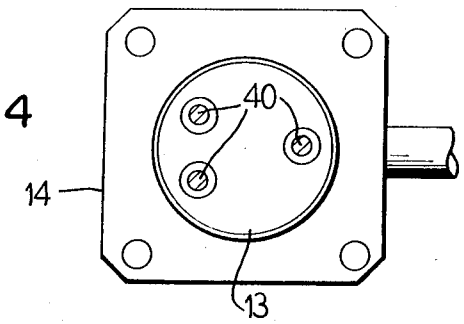
FIG. 4 is a fragmentary sectional view taken generally along the line IV—IV of FIG. 1.

A punch guiding stripper sleeve 36 slidably guides the punch 27 in the turret 12 and is in turn slidably supported in a bushing 37 mounted in the turret. The stripper sleeve 36 rests on a shoulder portion 38 of the punch 27 when the ram is in an elevated position at the start of a punching operation as shown in FIG. 1. The stripper sleeve 36 is lowered with the ram 13 and punch 27 and comes to rest on the workpiece 15. Thereafter continued downward movement of the ram brings a plurality of stripper pistons 40 into abutting contact with an upper face 41 of the stripper sleeve 36. As best seen in FIG. 4 three stripper pistons 40 are carried in the ram 13 and are arranged to provide an even downward force against the upper face 41 of the stripper sleeve 36. The stripper pistons 40 are operable carried in a cylinder bore 42 and each having fluid communication with a pressure compensated pump 43. The pump 43 is arranged to deliver a preset hydraulic pressure to the cylinder bores 42 to urge the stripper pistons 40 against the stripper sleeve 36 thereby clamping the workpiece 15 against the die 21. The tip portion 29 of the punch is guided by a button or tip guide 45 which may be constructed in accordance with the teachings of U.S. Pat. No. 4,261,237 issued to DiDonator, Jr. et al.

Figure 3:
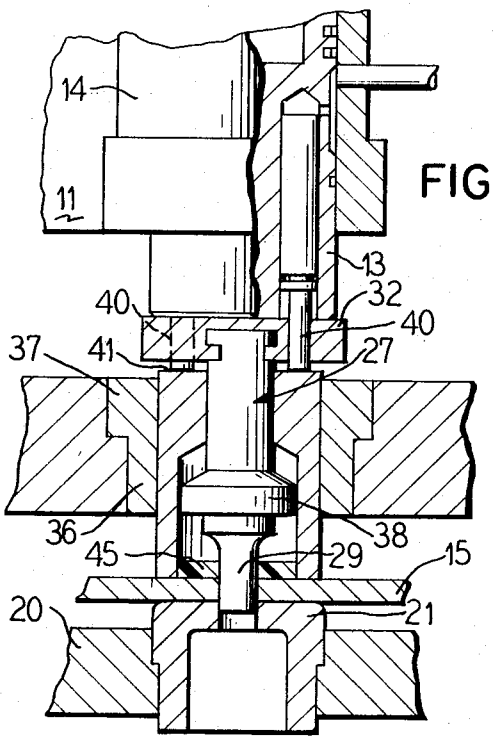
FIG. 3 is a view similar to FIGS. 1 and 2 but showing the ram and punch completing the punching operation while the punch guide and stripper sleeve remain in the workpiece clamping position.

After the stripper sleeve 36 abuts the workpiece 15, its downward travel is stopped and the punch 27 now slides downward in the stripper sleeve by the action of the ram 3 to pierce the workpiece 15 as best seen in FIG. 3. During the relative movement between the ram 13, carrying the cylinder bores 42 therealong, and the stripper sleeve 36 the stripper pistons 40 are forced up into their respective cylinder bores 42, thereby backflushing hydraulic fluid from the system. To this end a pressure relief valve 48 is provided in a pressure line 49 connected to the pump 43 to discharge excess hydraulic fluid to a hydraulic reservoir 51. The pressure compensated pump 43 produces fluid pressure only as needed and at a pre-set desired pressure. Accordingly the excess fluid backflushed from the cylinder bores 42 are discharged to the reservoir through the pressure adjustable valve 48. A pilot line 52 connected to the pressure line 49 provides the control connection for the valve 48.

Now when the punch tip 29 is withdrawn from the workpiece and the ram 13 begins to retract, the hydraulic fluid which was backflushed previously is now restored to the system thereby extending the stripper pistons 40 to maintain a continued clamping force to hold the stripper sleeve firmly against the workpiece 15 until the punch 27 is fully withdrawn from the workpiece. The stripping and clamping force is adjustable by varying the hydraulic pressure setting of the pump 43 and the valve 48. The valve pressure setting being slightly higher than the pressure setting of the pump 43.

It can therefore be seen from the above that our invention provides an improved apparatus for clamping a workpiece prior to punching an to use the same mechanism for stripping the workpiece off the punch as the ram is being retracted. It will be understood by those skilled in the art that this clamping and stripping apparatus is applicable to mechanical press drives as well as hydraulic operated ram presses.

Although the teachings of our invention have herein been discussed with reference to a specific embodiment, it is to be understood that these are by way of illustration only and that others may wish to utilize in different forms or applications.

We claim as our invention:

1. In a punch and ram assembly having a movable ram carrying a removable punch with a punch guide and stripper surrounding portion of the punch, the punch having limited axial movement relative to the guide and stripper, the improvement of hydraulic pistons carried by the ram and extendable into contact with a top surface of the guide and stripper to urge the guide and stripper against a workpiece contacted by the punch, means allowing limited independent movement of the ram and pistons and the punch and guide and stripper whereby the punch guide and stripper may be maintained against the workpiece top surface while the punch passes through and back through the workpiece in response to ram movement, the punch guide and stripper carried by the punch for movement away from the workpiece in dependent response to movement of the punch, at least portions of the punch intermediate a punch head end and a punch tip end having the punch periphery engaging and guided by a guide means cooperating between the punch and the guide and stripper for limiting the movement of the punch relative to the guide and stripper and for retaining the guide and stripper on the punch.

2. The punch and ram assembly of claim 1, wherein a hydraulic pressure system provides an adjustable stripping and clamping force to accommodate varying thicknesses of sheet and plate material.

3. The punch and ram assembly of claim 2, wherein the hydraulic pressure system includes a pressure compensated pump and a pilot actuated relief valve being adjustable to provide said adjustable stripping and clamping force.

4. The punch and ram assembly of claim 3 wherein pressure fluid is backflushed from said hydraulic pressure system when said ram is extendable relative to said punch guide and stripper, and fluid is restored to the system to extend said hydraulic pistons when said ram is retracted from said punch guide and stripper.

5. A machine tool punch comprising:

a frame having a lower member on which a die is supported and an upper arm having a vertical bore aligned with said die;

a punch guide stripper sleeve slidably disposed in said aligned bore and arranged to move into an abutting engagement with a workpiece supported on said die to apply a clamping force against said workpiece;

a punch having a body slidably carried in said punch guide stripper sleeve and having a punch tip extensible therefrom to punch a desired configuration in said workpiece;

the punch guide stripper sleeve carried by the punch, a ram carried on said frame in alignment with said bore and arranged to reciprocably move said punch relative to said workpiece, the ram carrying the punch, means for exchanging the punch and sleeve on the ram;

and a hydraulic stripper means carried by said ram and arranged to urge said stripper sleeve against said workpiece to apply said clamping force during predetermined periods of said reciprocable movement of said ram whereby said stripper sleeve clamps said workpiece prior to punching said workpiece and during the time said punch is withdrawn from said workpiece.

6. The machine tool punch of claim 5, wherein said hydraulic stripper means includes a hydraulic pressure system to provide an adjustable clamping force to accommodate varying thicknesses of sheet and plate material.

7. The machine tool punch of claim 6, wherein said hydraulic pressure system includes a pressure compensated pump and a pilot actuated relief valve being adjustable to provide said adjustable clamping force.

* * * * *